US007784522B2

(12) United States Patent
Miller

(10) Patent No.: US 7,784,522 B2
(45) Date of Patent: Aug. 31, 2010

(54) LOCATOR AND SHUTTER SLAT

(75) Inventor: James V. Miller, Glen Ellyn, IL (US)

(73) Assignee: Qualitas Manufacturing Incorporated, Itasca, IL (US)

( * ) Notice: Subject to any disclaimer, the term of this patent is extended or adjusted under 35 U.S.C. 154(b) by 0 days.

(21) Appl. No.: 11/058,879

(22) Filed: Feb. 16, 2005

(65) Prior Publication Data

US 2005/0205223 A1 Sep. 22, 2005

Related U.S. Application Data

(63) Continuation-in-part of application No. 10/802,385, filed on Mar. 17, 2004.

(51) Int. Cl.
*E06B 3/06* (2006.01)

(52) U.S. Cl. ..... 160/235; 160/133

(58) Field of Classification Search ..... 160/235, 160/236, 133, 183, 201
See application file for complete search history.

(56) References Cited

U.S. PATENT DOCUMENTS

| | | | |
|---|---|---|---|
| 638,314 | A | 12/1899 | Blades |
| 845,526 | A | 2/1907 | Collins |
| 876,593 | A | 1/1908 | Rush |
| 1,014,315 | A | 1/1912 | McCloud |
| 1,352,656 | A | 9/1920 | Cahill |
| 1,579,839 | A | 4/1926 | Raper |
| 1,776,119 | A | 9/1930 | Johnson |
| 1,892,570 | A | 12/1932 | Ginder |
| 1,918,415 | A | 7/1933 | Miller |
| 2,350,287 | A | 5/1944 | Michelman |
| 2,545,400 | A | 3/1951 | White |
| 2,812,813 | A | 11/1957 | Zarnowski |
| 2,858,883 | A | 11/1958 | Rapin |
| 3,292,685 | A | 12/1966 | Clark |
| 3,431,964 | A | 3/1969 | Rogers |
| 3,489,200 | A | 1/1970 | Recchione |
| 3,670,797 | A | 6/1972 | Sassano |
| 4,037,639 | A | 7/1977 | Jones |
| 4,294,302 | A | 10/1981 | Ricke, Sr. |
| 4,332,287 | A | 6/1982 | Stolpe |
| 4,343,340 | A | 8/1982 | Paule |
| 4,345,635 | A | 8/1982 | Solomon |
| 4,379,479 | A | 4/1983 | Whiting |

(Continued)

OTHER PUBLICATIONS

LAKAL Rolladensysteme, LAKEL Profil AHS 75 brochure, 4 pages—undated prior art.

(Continued)

*Primary Examiner*—Blair M. Johnson
(74) *Attorney, Agent, or Firm*—Ice Miller LLP

(57) ABSTRACT

A rolling shutter and a slat for use in a rolling shutter are provided. The slat comprises an engaging track located at a first edge and a receptacle track located at a second edge. Illustratively, the engaging track has a hook-shaped profile and is disposed at an acute angle relative to an adjacent part of the body portion, is disposed at an angle of less than 180° relative to a vertical axis of the slat, or has a hook-shaped profile that curves for more than 180°, and the receptacle track comprises a lip and a guard defining a space adapted to receive therein an engaging track of an adjacent slat.

15 Claims, 11 Drawing Sheets

U.S. PATENT DOCUMENTS

| | | | |
|---|---|---|---|
| 4,386,645 | A | 6/1983 | Dever et al. |
| 4,519,434 | A | 5/1985 | Forquer |
| 4,611,848 | A | 9/1986 | Romano |
| 4,628,982 | A | 12/1986 | Labelle |
| 4,690,193 | A | 9/1987 | Morrison et al. |
| 4,718,472 | A | 1/1988 | Hormann |
| 4,723,588 | A | 2/1988 | Ruppel |
| 4,738,296 | A | 4/1988 | Hatch |
| 4,795,206 | A | 1/1989 | Adams |
| 4,807,687 | A | 2/1989 | Finch et al. |
| 4,929,862 | A | 5/1990 | Hamilton et al. |
| 4,930,563 | A | 6/1990 | Finch et al. |
| 5,070,925 | A | 12/1991 | Paule |
| 5,154,468 | A | 10/1992 | Teigen et al. |
| 5,165,746 | A | 11/1992 | Teigen |
| 5,204,147 | A | 4/1993 | Schneider |
| 5,209,281 | A | 5/1993 | Kraeutler |
| 5,253,694 | A | 10/1993 | Bernardo |
| 5,265,663 | A | 11/1993 | Munekata et al. |
| 5,343,924 | A | 9/1994 | Hoffman |
| 5,365,990 | A | 11/1994 | Ueda |
| 5,372,175 | A | 12/1994 | Calhoun et al. |
| 5,377,738 | A | 1/1995 | Cooper |
| 5,426,893 | A | 6/1995 | Hoffman |
| 5,469,905 | A | 11/1995 | McKinney et al. |
| 5,482,104 | A | 1/1996 | Lichy |
| 5,575,322 | A | 11/1996 | Miller |
| 5,586,592 | A | 12/1996 | McGregor |
| 5,601,130 | A | 2/1997 | Werner et al. |
| 5,611,383 | A | 3/1997 | Hoffman |
| 5,613,539 | A | 3/1997 | Kraler |
| 5,657,805 | A | 8/1997 | Magro |
| 5,682,937 | A | 11/1997 | Decrane et al. |
| 5,839,493 | A | 11/1998 | Quasius |
| 5,850,862 | A | 12/1998 | Miller |
| 5,996,669 | A | 12/1999 | Miller |
| 6,085,822 | A | 7/2000 | Miller |
| 6,095,225 | A | 8/2000 | Miller |
| 6,129,132 | A * | 10/2000 | Denoual et al. ..... 160/235 |
| 6,422,289 | B1 | 7/2002 | Miller |
| 6,631,749 | B1 | 10/2003 | Zabala |

OTHER PUBLICATIONS

SIRO Safety Roller Blind brochure 4 pages—prior art.

Sweet's General Building & Renovation 1993 Catalog File, Rollaway Insulating Security Shutters, Roll-A-Way, #B500, 8 pages.

Sweet's General Building & Renovation 1993 Catalog File, QMI Roll Shutter Supply, "BuyLine 6925" 4 pages.

Sweet's General Building & Renovation 1993 Catalog File, Solaroll, Solaroll Shade & Shutter Corporation, Catalog 561, #B505, 44 pages.

Sweet's General Building & Renovation 1993 Catalog File, Rolladen Rollshutters, Rolladen Inc., #B499, 8 pages.

Sweet's General Building & Renovation 1993 Catalog File, Hurst Shutters Accordion Shutters/Removable Shutters, Hurst Awning Company, Inc. #B492, 8 pages.

Sweet's General Building & Renovation 1993 Catalog File, Enviroblind Exterior Rolling Shutters, Environmental Seal and Security Co., Inc. #B489, 4 pages.

* cited by examiner

LOCATOR AND SHUTTER SLAT

This application is a continuation-in-part of U.S. patent application No. 10/802,385, filed Mar. 17, 2004, which is expressly incorporated by reference herein.

BACKGROUND OF THE INVENTION

The present invention relates to shutters and in particular to shutters of the roller type. It furthermore relates to a shutter having low clearance and improved retraction capability.

DESCRIPTION OF THE RELATED ART

Conventional roller shutters are designed to provide security from break-ins or protection from storms. Because such protection and security may not always be necessary or desired, such as during the day when a retail store is open for business or during fine weather when a homeowner wishes to open windows or enjoy an ocean view, roller shutters are designed to be retractable into a casing in which they are stored. In some examples, to facilitate compact storage, the rigid shutter slats that are designed to resist hurricane winds and burglars also must be capable of conforming to a roll.

One conventional shutter slat is made to conform to a roll by providing a loose articulation between slats. Slats are slidably engaged at the upper edge of one slat and the lower edge of another slat. The upper edge comprises a vertical projection terminating in a hook-shaped profile. The lower edge comprises a first portion and a second portion that cooperate to define a vertical pocket. The hook-shaped profile of the upper edge allows the upper edge to engage the first portion of the lower edge, also having a hook-shaped profile. The upper edge is prevented from undesirably disengaging the lower edge by the second portion of the lower edge, which comprises a guard extending downward to slightly below the hook-shaped profile of the lower edge, defining a horizontal aperture between the first and second portions of the lower edge. The vertical pocket defined by the first and second portions of the lower edge is similar in depth to the height of the vertical projection of the upper edge. This shutter configuration's flexibility arises from the pivoting of the vertical portion of the upper edge within the horizontal aperture.

One result of this configuration is that the upper edge has significant vertical clearance within the vertical pocket. Shutters according to this configuration are known to have a clearance up to one-quarter inch per slat, or even more. A shutter having 48 slats and one-quarter inch clearance per slat would then have a total clearance of twelve inches between the fully open and fully closed positions. To raise such a shutter having a torsion spring as a counterbalance, a user must lift the bottom slat either by hand or mechanically to correct for the full amount of clearance before the shutter will begin to retract. In such a shutter, a user would have to lift approximately 150 pounds by twelve inches in order to engage the shutter's retraction mechanism. Shutters of this configuration do not obtain full benefit of the counterbalance, as provided by the torsion spring or by other means.

A further result of this configuration is that the loosely articulated slats are known to be noisy. The slats rattle against each other during extension and retraction. In addition, when the roller shutter is deployed, the normal forces of the wind are sufficient to cause the slats to rattle audibly.

A second conventional solution to the problem of compact storage includes integration of a boss concentric with the articulation between adjoining slats, as described in U.S. Pat. No. 6,095,225 to Miller, titled "Shutter Slat with Integrated Boss." Slats in this configuration are also slidably engaged at the upper edge of one slat and the lower edge of another slat. The upper edge comprises a short vertical projection terminating in a c-shaped screw boss, and the lower edge comprises a c-shaped channel having a diameter sufficient to accommodate the upper edge. The flexibility of this shutter configuration arises from the cooperation of the rounded internal surface of the c-shaped channel and the rounded external surface of the c-shaped screw boss. The diameter of the upper edge is smaller than the diameter of the c-shaped channel, but greater than the width of the aperture defined by the c-shaped channel, preventing the upper edge from simply falling out of the c-shaped channel provided by the lower edge.

One result of this configuration is that if the exposed portion of the c-shaped channel of the lower edge gives way upon exertion of pressure on the articulation, the slats may separate undesirably. Because the retention of the upper edge by the c-shaped channel is based on a relatively small difference in size, damage to either edge may result in a breach of the curtain. For example, if a putative intruder hits the shutter, the c-shaped channel may be forced open. Even if the channel is bent only slightly, once a gap is formed between an upper edge and a lower edge, the two slats may be pried apart with undesirably slight effort.

SUMMARY OF THE INVENTION

According to the present invention, smooth extension and retraction of the roller shutter may be achieved with significantly less effort than required by prior art devices by minimizing the clearance between the engaging track of one shutter slat and the receptacle track of the adjacent shutter slat. There is thus provided a shutter for a building aperture comprising a plurality of shutter slats each having a first face and a second face, and a first end and a second end, and an upper and a lower horizontal edge, which are articulated to form a roller shutter having a first face and a second face, and a first end and a second end. Each shutter slat further has an engaging track and a receptacle track, which run along opposing horizontal edges of each shutter slat. Illustratively, the shutter further comprises two guides, with one guide locatable at either end of the roller shutter.

Advantageously, flexibility between adjacent slats may be achieved by the alteration of the angle of the engaging track relative to the vertical axis of the shutter curtain. In one embodiment, the present invention provides for the engaging track to be disposed at an acute angle relative to an adjacent part of the body portion or at an angle of less than 180° relative to the vertical axis of an upright shutter slat. In contrast to prior art shutter slats, the angled engaging track of the present invention allows shutter slats to pivot freely while remaining securely disposed within the receptacle track, even when the clearance between engaging and receptacle tracks is decreased. Other features providing flexibility include a concave surface provided on at least part of the articulation surface of the receptacle track or the articulation surface of a guard and providing the engaging track with a hook-shaped member having a curved section that extends for more than 180°. The shutter slat of the present invention may have any combination of these features.

According to another aspect of the invention, the stability of the connection between engaging track and receptacle track is further improved by providing a guard along the receptacle track. Use of the guard provides protection for the lip and engaging track against damage inflicted on the first face of the roller shutter, such as by a storm or an intruder. Additionally, in some embodiments the security of the shutter slat within the guides is improved by the provision of a receptacle for a retention screw above the main pocket of the receptacle track rather than concentrically with the articulation. The retention screw, which is used for slidably mounting each shutter slat on the first and second guides, is therefore shielded from external forces, including attempts to compromise the integrity of an articulation by forcing two shutter slats apart. In these embodiments, the combination of the receptacle and the guard as provided in the present invention improves stability and security over the use of a concentric receptacle by increasing the force needed to separate an articulation between slats or separate the roller shutter from a guide.

In yet another aspect of the present invention, the complementary curved profiles of the engaging and receptacle tracks combined with the reduced clearance between shutter slats reduces the noise associated with operation and use of the roller shutter. As the engaging track pivots within the receptacle track, the convex interior of the engaging track contacts the concave interior of the receptacle track, and the former will slide against the latter. In one embodiment of the present invention, the engaging track has no flat (vertical) surfaces to rattle or clank between the first and second portions of the receptacle track.

Additional features of the present invention will become apparent to those skilled in the art upon consideration of the following detailed description of preferred embodiments exemplifying the best mode of carrying out the invention as presently perceived.

BRIEF DESCRIPTION OF THE DRAWINGS

Embodiments of the invention will now be explained in further detail by way of example only with reference to the accompanying figures, in which.

DETAILED DESCRIPTION

Figure 5:
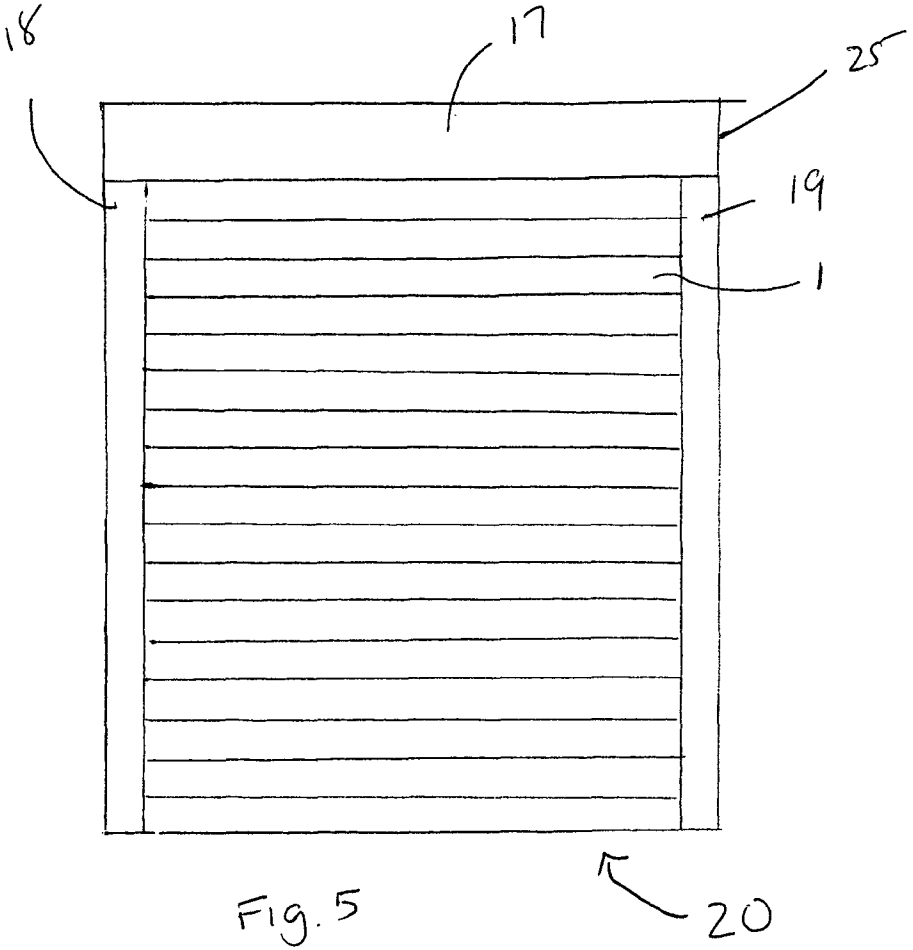
FIG. 5 is an elevation of a window aperture including a shutter according to the present invention.
Figure 6:
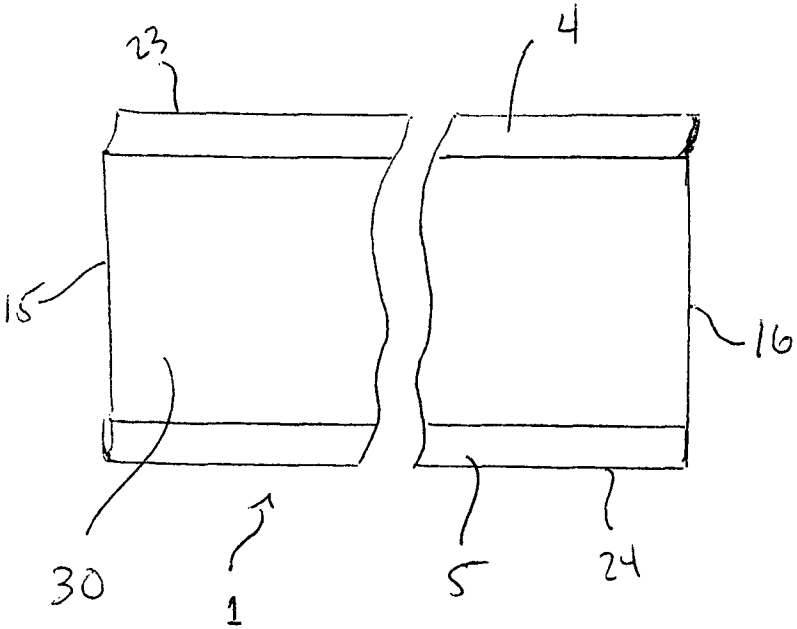
FIG. 6 is an elevation of a shutter slat according to the present invention.

FIG. 5 shows a roller shutter 20 according to the present invention, as installed on a building aperture 25 such as a window or door. FIG. 6 depicts one shutter slat according to the present invention, a plurality of which are shown in the roller shutter 20 in FIG. 5. Illustratively, shutter slat 1 is an elongated body of single-ply extruded aluminum having a first end 15 and a second end 16, a body portion 30 bounded by an upper edge 23 and a lower edge 24, and an engaging track 4 and a receptacle track 5.

Figure 1:
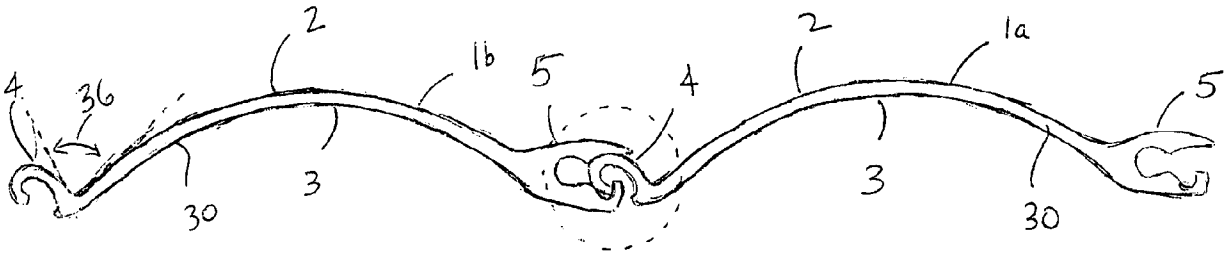
FIG. 1 is a side view of two shutter slats according to the present invention.

FIG. 1 is a side view of two shutter slats according to the present invention. Each shutter slat 1*a* and 1*b* has a first side 2 and a second side 3, a body portion 30, an engaging track 4, and a receptacle track 5. FIG. 1 shows the engaging track 4 of the right slat 1*a* engaging receptacle track 5 of the left slat 1*b*.

Figure 2:
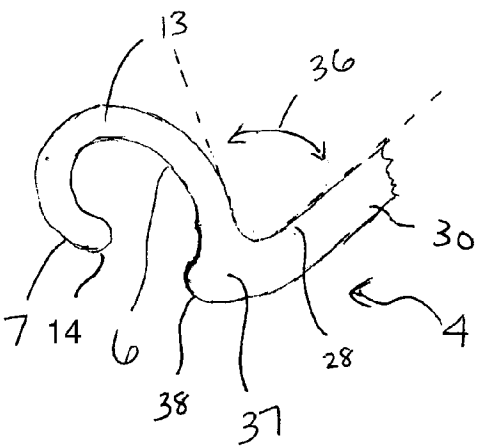
FIG. 2 is a detailed side view of an engaging track according to the present invention.

A detail of engaging track 4 is shown in FIG. 2. Engaging track 4, illustratively located along substantially all of upper edge 23 of shutter slat 1, has a hook-shaped profile. Engaging track 4 has a hook-shaped member 13 comprising an inner surface 6 and an outer surface 7. In the illustrative embodiment, engaging track 4 is disposed at an acute angle 36 to the adjacent portion 28 of body 30. It is to be understood that engaging track 4 could, in the alternate, be located at lower edge 24. As illustrated, hook-shaped member 13 has a curved portion that extends beyond 180°, illustratively to 210-280°, and, as in the illustrative embodiment, to approximately 265° from connection point 37 to terminate at a tip 14. The curved portion may have a singe radius, or, as illustrated, the radius may increase toward connection point 37 of slat 1. As shown, angle 36 is less than 90°, illustratively 50-85°, and more illustratively 55-75°. In the illustrative embodiment, angle 36 is about 69°.

Figure 3:
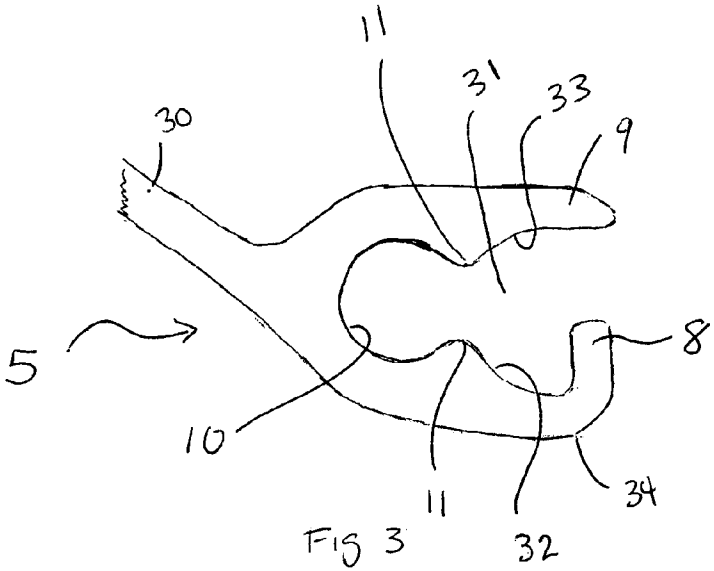
FIG. 3 is a detailed side view of a receptacle track according to the present invention.

FIG. 3 depicts a detail of receptacle track 5, located at lower edge 24. Receptacle track 5 runs substantially the length of lower edge 24 shutter slat 1. Receptacle track 5 further comprises a lip 8, a guard 9, and a receptacle 10. Lip 8 and guard 9 are provided with articulation surfaces 32 and 33, respectively. As shown, articulation surfaces 32 and 33 may be wholly or partially concave. Such concave articulation surfaces allow for improved articulation between adjacent slats without the need to provide additional vertical clearance. When the slat 1 is in a vertical position, receptacle 10 is located above the aperture defined by lip 8 and guard 9.

Figure 8:
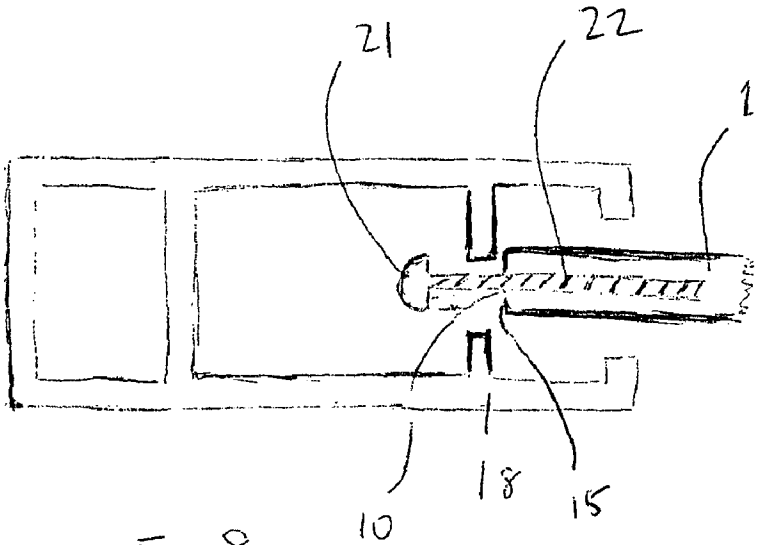
FIG. 8 is a partial horizontal sectional view of a shutter slat according to the present invention engaged in a track.

Still referring to FIG. 3, receptacle 10 is adapted to receive retention screw 22 (shown in FIG. 8). It is to be understood that receptacle track 5 could, in the alternate, be located at upper edge 23, but that receptacle 10 still would be located between the body portion of the shutter slat 1 and the aperture defined by lip 8 and guard 9. While receptacle 10 is a space distinct from articulation space 31 and separated by shoulders 11, as shown, receptacle 10 has a portion that is open to an in communication with articulation space 31. Although as shown, receptacle 10 is in open communication with articulation space 31, receptacle 10 is protected from the collection of dirt and grime by lip 8, guard 9, and engaging track 4. If desired, it is understood that receptacle 10 may be completely separated from articulation space 31. In such an embodiment, articulation surface 32 illustratively would be connected with articulation surface 33, to provide a single continuous articulation surface. It is also understood that in a double ply-slat configuration similar to that shown in FIG. 11, the receptacle may be centrally located between the receptacle track and engaging track, within the body of the slat.

Figure 4:
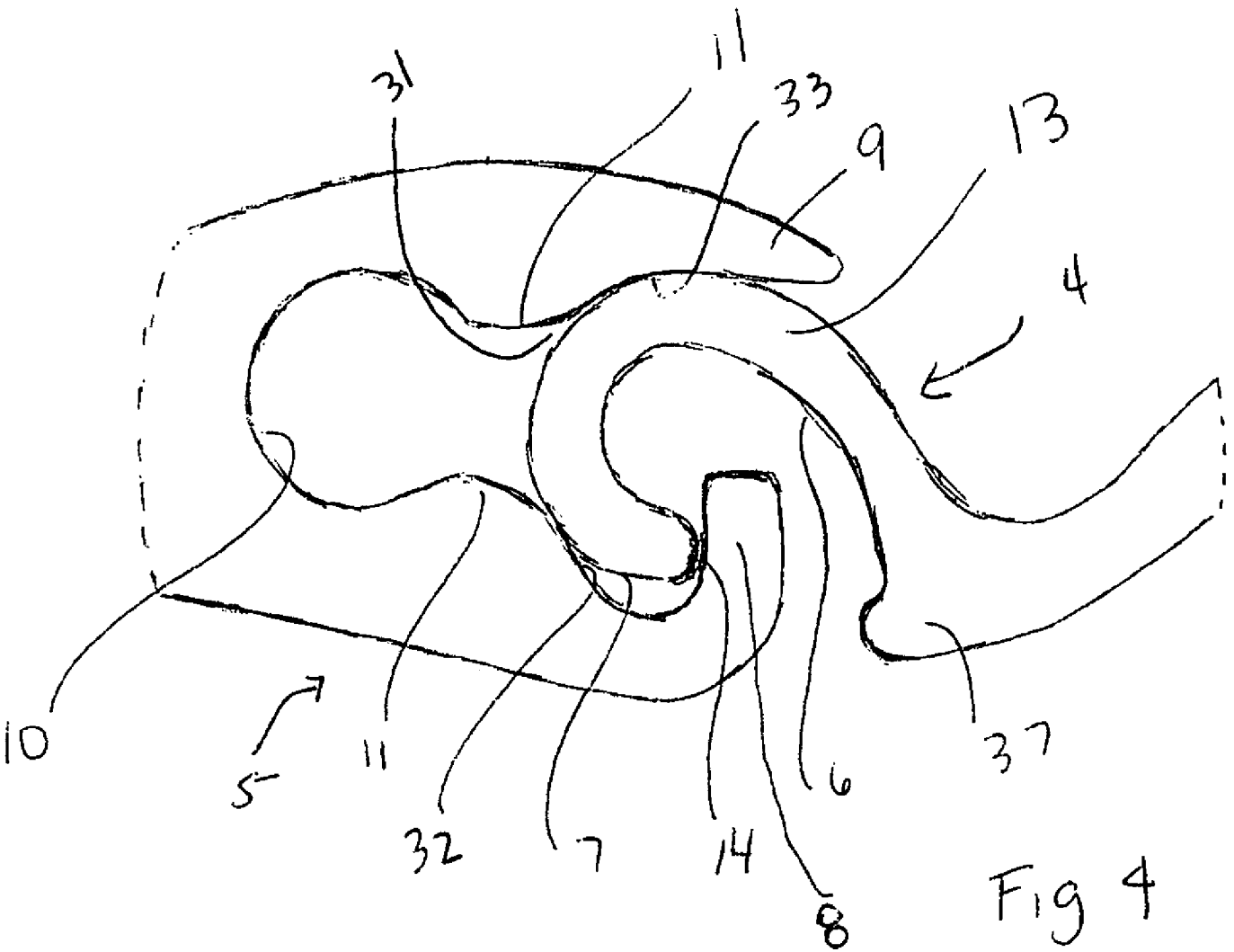
FIG. 4 is a detailed side view of an engaging track in engaged relationship with receptacle track.

FIG. 4 is a detailed side view of the engaging track 4 in engaged relationship with the receptacle track 5 of an adjacent slat, as shown in FIG. 1. As shown in FIG. 4, the engaging track 4 is shown positioned in the receptacle track 5 in a fully extend, open shutter. The outer surface 7 of the hook-shaped member 13 of the engaging track 4 is convex and seats against the concave articulation surfaces 32, 33 of lip 8 and guard 9. The lip 8 of receptacle track 5 retains the hook-shaped member 13 in the receptacle track 5. Lip 8 also extends into a space defined by hook-shaped member 13. As illustrated in FIGS. 1-4, both receptacle track 5 and engaging track 4 are formed integrally with body 30. However, it is understood that either or both tracks could be formed separately and fixed to the body 30. Also as illustrated, the engaging track 4 of one slat 1 directly engages receptacle track 5 of the adjacent slat. A minimal amount of vertical clearance, illustratively no more than 0.05 inches and more illustratively no more than 0.01 inches, within articulation space 31 permits slight vertical movement. In the present example, a vertical movement of 0.0041 inches is provided. However, it is understood that more or less vertical movement may be provided, depending on the specific design of the roller shutter. Slight movement between tip 14 of the hook-shaped member 13 and lip 8 of receptacle track 5 also may permit the lower slat to extend slightly beyond vertical alignment to a backbend of approximately 3°. In the open position, the weight-bearing portion of receptacle track 5 is lip 8. As the shutter is rolled, the weight-bearing portion may shift to articulation surface 32 of the receptacle track 5. Although receptacle 10 is open to the adjacent engaging track 4, the engaging track 4 is securely retained in receptacle track 5, and receptacle 10 is protected.

FIG. 5 shows an elevation of a plurality of shutter slats 1 according to the present invention, articulated into a roller shutter 20 which may be installed on a building aperture 25 such as a window or door. Details of building aperture 25 are not illustrated for the sake of clarity. Building aperture 25 is further equipped with a shutter casing 17 and a pair of guides 18 and 19, located on opposite lateral edges of building aperture 25. Roller shutter 20 may be rolled up for storage within shutter casing 17. The first and second ends 15, 16 of slat 1, as shown in FIG. 6, are adjacent guides 18 and 19. Retention screw 22, as shown in FIG. 8, provides for secure alignment of ends 15 and 16 with guides 18 and 19.

Figure 7B:
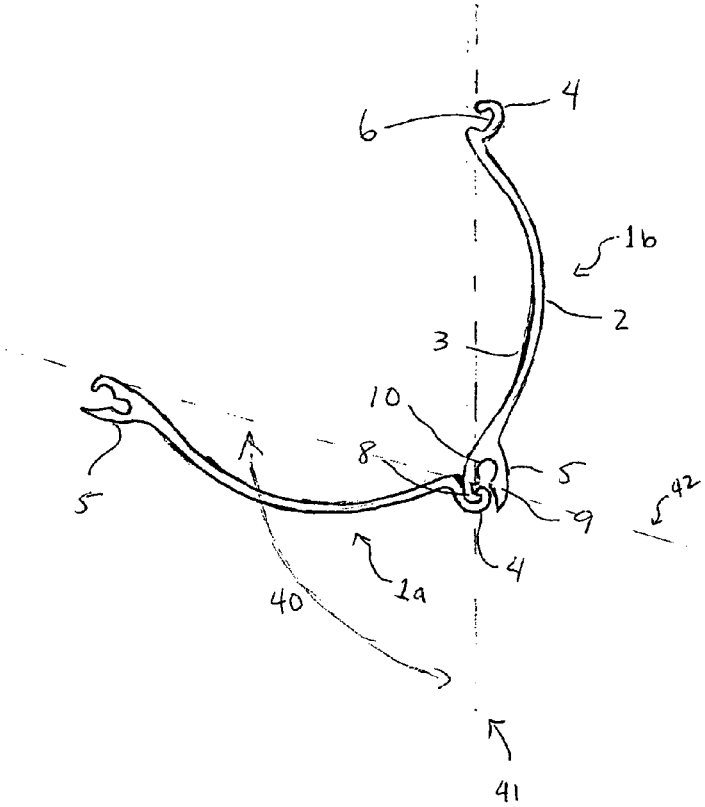
FIG. 7B is similar to FIG. 7A, except showing range of motion of the two shutter slats.
Figure 7A:
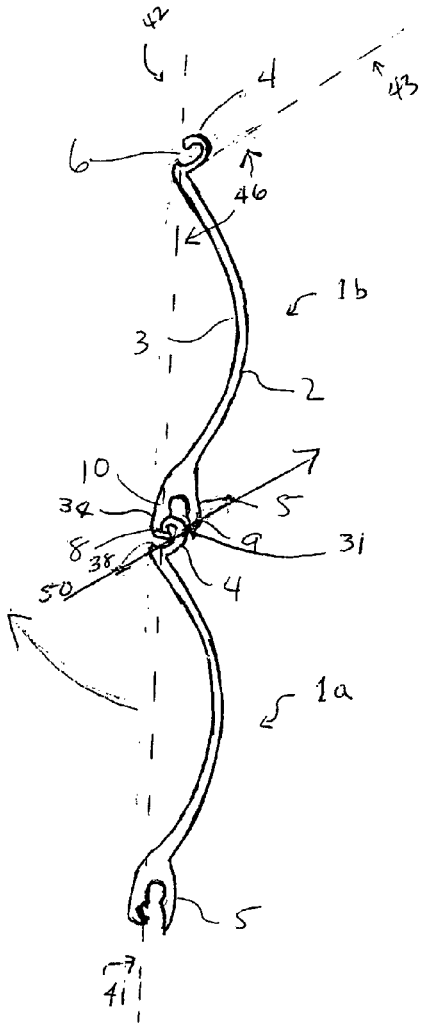
FIG. 7A is a side view of the cooperation of two shutter slats according to the present invention.

FIG. 7A is a side view of two shutter slats 1*a*, 1*b* according to the present invention. Engaging track 4 of slat 1*a* is slidably engaged within receptacle track 5 of adjacent shutter slat 1*b*. Inner surface 6 rests against lip 8. Guard 9 shields the connection of engaging track 4 with lip 8, preventing engaging track 4 from undesirably disengaging from receptacle track 5. Guard 9 also protects the engaging track 4 and lip 8 from exposure to forces applied to the first side 2 of shutter slat 1. Because engaging track 4 does not bear directly upon guard 9, damage to first side 2, including to guard 9, is less likely to disengage the articulation between shutter slats 1 than in prior art shutters in which an exposed portion of a lower track was weight-bearing. As shown in FIG. 7A, the bottom slat 1*a* is in a straight position, i.e. the position as in an open shutter, with the vertical axis 41 of slat 1*a* substantially or completely in line with the vertical axis 42 of slat 1*b*. As discussed above, there is very little clearance space provided between slats. Still, bottom slat 1*a* can articulate in the direction shown by the arrow illustratively more than 90°. In some embodiments, slat 1*a* may articulate more than 100°. Articulation of slat 1*a* moves vertical axis 41 out of alignment with vertical axis 42 of slat 1*b*, to define angle 40. As shown in FIG. 7B, angle 40 is approximately 106°. Protrusion 38, as best shown in FIG. 2, is provided at connection point 37, and may be used to contact an exterior surface 34 of the lip 8 of an adjacent slat, to prevent excessive articulation that may otherwise result in disengagement of the slats. Protrusion 38 may be increased or decreased in size, or omitted altogether, depending on the amount of articulation desired.

As discussed above, in the illustrative embodiment, a vertical clearance in articulation space 31 of approximately 0.0041 inches is provided. Because such a small vertical clearance is provided, the user need only raise the bottom slat less than a quarter inch to engage the shutter's retraction mechanism. Once the bottom slat is so raised, an optional retraction spring provided in shutter casing 17 would assist in lifting the shutter and less power would be required to raise the shutter. Further, because of acute angle 36, when a bottom slat 1*a* is lifted against an upper slat 1*b*, a force is provided against upper slat 1*b* in the direction of arrow 50, as shown in FIG. 7A. As the shutter 20 is rolled into the shutter casing 17, this force assists the slats in articulating, which, in turn, assists the shutter 20 in rolling up.

Also shown in FIG. 7A is an alternative measurement for the angle of engaging track 4. Rather than measuring the angle 36 between engaging track 4 the adjacent portion 28 of body 30, in FIG. 7A the angle of engaging track 4 is measured against vertical axis 42. This angle 46 is less than 180°, illustratively 95-160°. As illustrated, the angle 46 is approximately 125°. This method of measuring the angle of the engaging track 4 is not affected by the curvature of body 30.

FIG. 8 is a partial sectional view according to one embodiment of the present invention. A shutter slat 1 is shown in combination with a guide 18 and a retention screw 22. A retention screw 22 is preferably inserted in receptacle 10 of shutter slat 1 for use with a guide 18, 19. The head 21 of the retention screw 22 protrudes from receptacle 10 and slides within a vertical guide 18, 19 provided at each end of the roller shutter 20 (shown in FIG. 5). In this illustrative embodiment, the retention screw 22 does not restrict the rotation or pivoting of engaging track 4 within receptacle track 5. As illustrated, for minimization of the rolled shutter, that the diameter of the head 21 of the retention screw 22 is not larger than the external profile of the receptacle track 5. As shown in FIG. 8, because of the space between the head 21 of screw 22 and the first end 15 of slat 1, the receptacle track of one slat may slide horizontally with respect to the engaging track of the adjacent slat. The amount of horizontal sliding may be limited in part by the space between the head 21 of screw 22 and the first end 15 of slat 1 or by the configuration of guides 18, 19.

Figure 9:
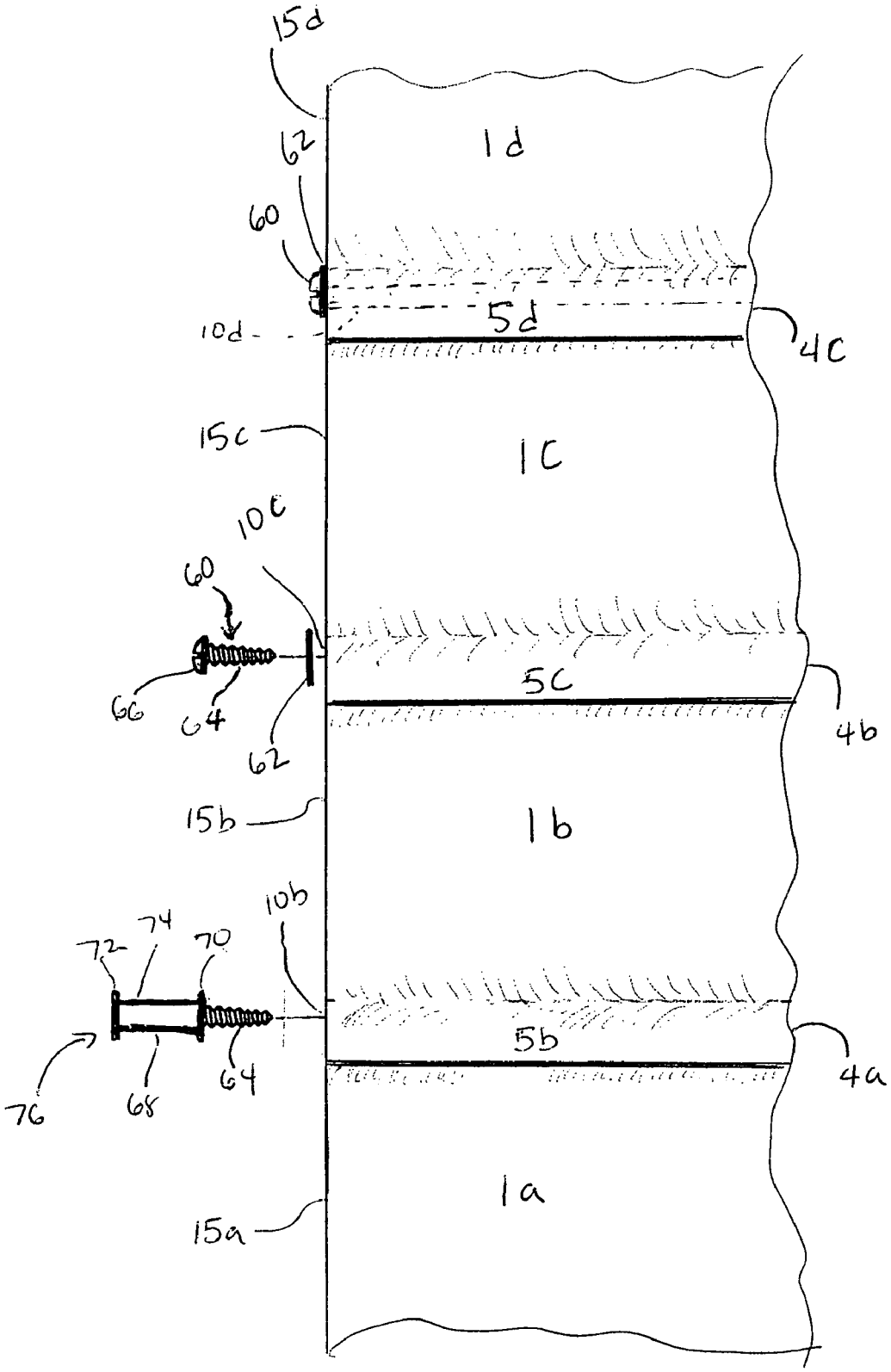
FIG. 9 is a fragmentary front view of a roller shutter incorporating a plurality of slats of FIG. 1.

FIG. 9 illustrates another embodiment of the present invention. FIG. 9 shows four slats 1*a*, 1*b*, 1*c*, 1*d* of a roller shutter. Screw 60 is inserted into receptacle 10*d* (shown in phantom) of slat 1*d*. As shown, washer 62 is provided between screw 60 and slat 1*d*. Screw 60 and washer 62 keep slats 1*c* and 1*d* in vertical alignment by engaging both first end 15*d* of slat 1*d* and first end 15*c* of slat 1*c* and restraining receptacle track 5*d* of slat 1*d* and engaging track 4*c* of slat 1*c* from sliding horizontally with respect to each other. A similar screw and washer may be inserted into the opposite side of receptacle 10*d* at the second end 16*d* (not shown of slat 1*d*). Another screw 60 and washer 62 is shown in exploded view, for insertion into receptacle 10*c*. A plurality of screws 60 may be used to maintain vertical alignment of the roller shutter. Such a shutter may be installed without vertical guides 18, 19.

In some embodiments, it may be desirable to maintain vertical alignment and provide engagement with guides 18, 19. In such an embodiment of the roller shutter, an extended screw 76 may be used in place of screw 60. Still referring to FIG. 9, as with screw 60, extended screw 76 has a threaded portion 64 for insertion into receptacle 10*b*. However, head 66 is replaced by extension member 68. The extended screw 76 is adapted to keep the slats 1*a* and 1*b* vertically aligned and to retain the shutter curtain within guides 18, 19, to prevent the roller shutter from pulling out of the guides 18, 19 during either an attempted break in or extreme wind conditions. Extension member 68 has an inner flange 70 and an outer flange 72 separated by a neck 74 having a smaller diameter than the flanges 70, 72. Inner flange 70 is configured to maintain vertical alignment of slats 1*a* and 1*b*, while outer flange 72 is configured for retention within guides 18, 19. Illustratively, the flanges 70, 72 are no larger than the external profile of the receptacle track 5*b* and do not effect how tightly the shutter curtain may be rolled.

Figure 10:
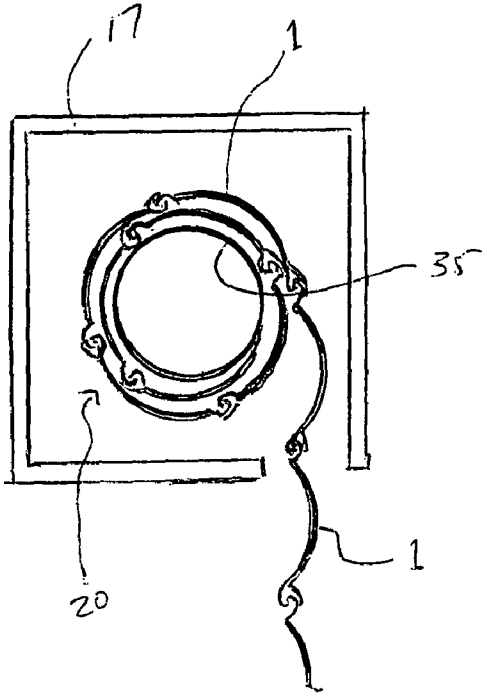
FIG. 10 is a side view of a roller shutter of the present invention rolled into a shutter casing.

FIG. 10 shows roller shutter 20 rolled into shutter casing 17. Although little vertical space is provided between slats 1, slats 1 articulate freely enough such that roller shutter 20 fits compactly into shutter casing 17. In contrast to prior art systems that require significant clearance at the articulation in order to allow pivoting, the angled engaging track 4 of the present invention allows shutter slat 1 to pivot freely within receptacle track 5. The resulting flexibility of the roller shutter 20 allows the roller shutter 20 to be rolled up onto support member 35 at a favorably compact size.

Figure 11:
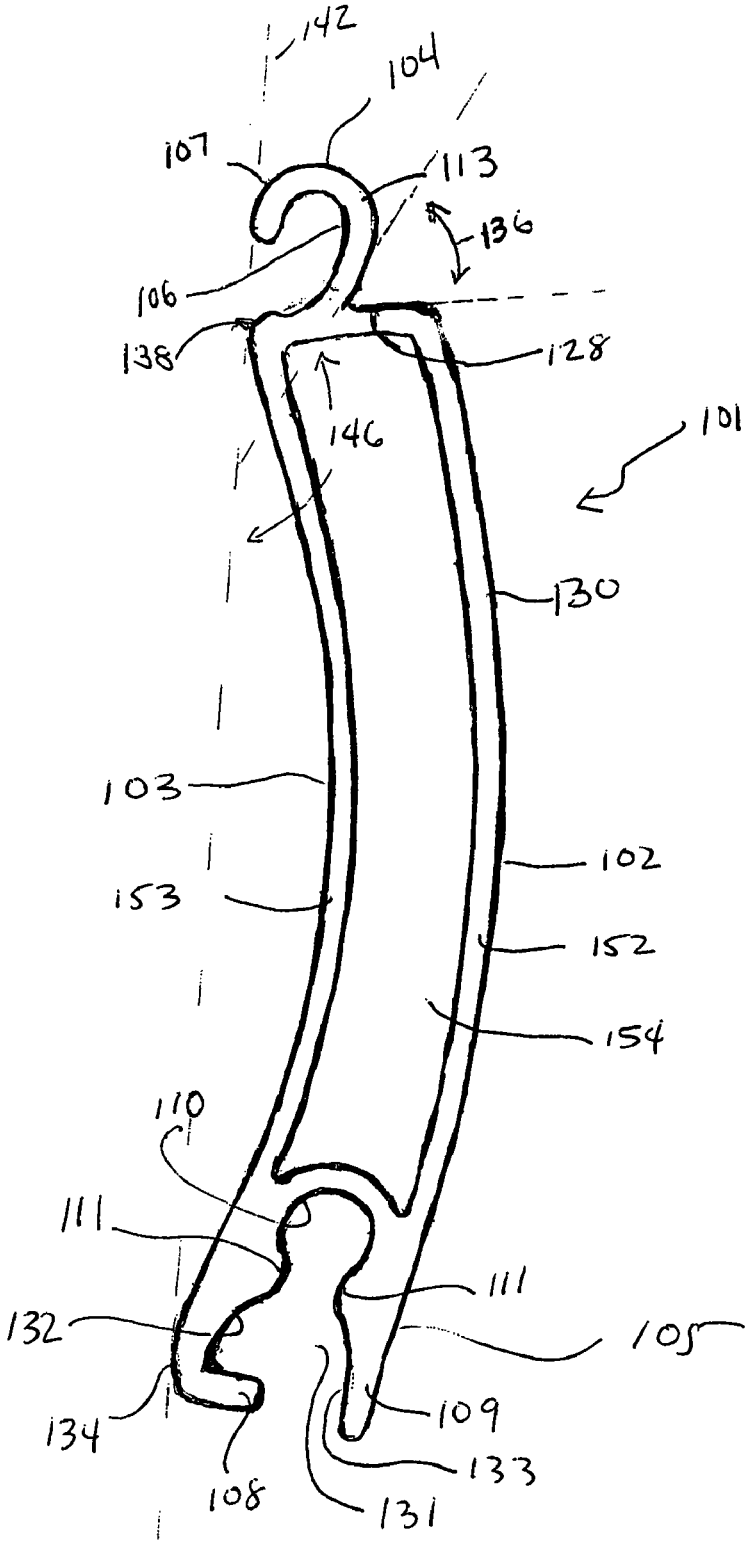
FIG. 11 is a side view of another embodiment of a shutter slat according to the present invention.

FIG. 11 shows an alternative shutter slat 101 according to the present invention. Shutter slat 101 is similar to shutter slat 1, having first side 102 and a second side 103, a body portion 130, an engaging track 104, and a receptacle track 105. However, slat 101 is a two-walled slat, with a first wall 152 provided at first side 102 and a second wall 153 provided at second side 103. First wall 152 and second wall 153 define a hollow space 154 therebetween.

Engaging track 104 has a hook-shaped profile similar to engaging track 4 as shown in FIG. 2. Engaging track 104 has a similar hook-shaped member 113 comprising an inner surface 106, an outer surface 107 and a protrusion 138. As with the previous embodiment, engaging track 104 is disposed at an acute angle 136 to the adjacent portion 128 of body 130, and is disposed at an angle of less than 180° relative to the vertical axis 142 of the upright shutter slat 101. As illustrated, acute angle 136 is approximately 55° and the angle 146 of engaging track 104 measured against vertical axis 142 is about 150°, although it is understood that other angles are within the scope of this invention.

Receptacle track 105 is similar to receptacle track 5 of FIG. 3, with a lip 108, a guard 109, and a receptacle 110. Lip 108 and guard 109 are provided with articulation surfaces 132 and 133, respectively and define space 131. The receptacle track 105 is sized to receive engaging track 104 in engaged relationship with the receptacle track 105, similar to the engaged relationship shown in FIG. 4. While receptacle 110 is shown contiguous with space 131, separated only by shoulders 111, it is understood that receptacle 110 could be located in another position in receptacle track 105, illustratively within space 154. When the receptacle is located within space 154, structure forming the receptacle can also be used to provide additional support between first 152 and second wall 153.

Figures 12A, 12B, 12C, 12D:
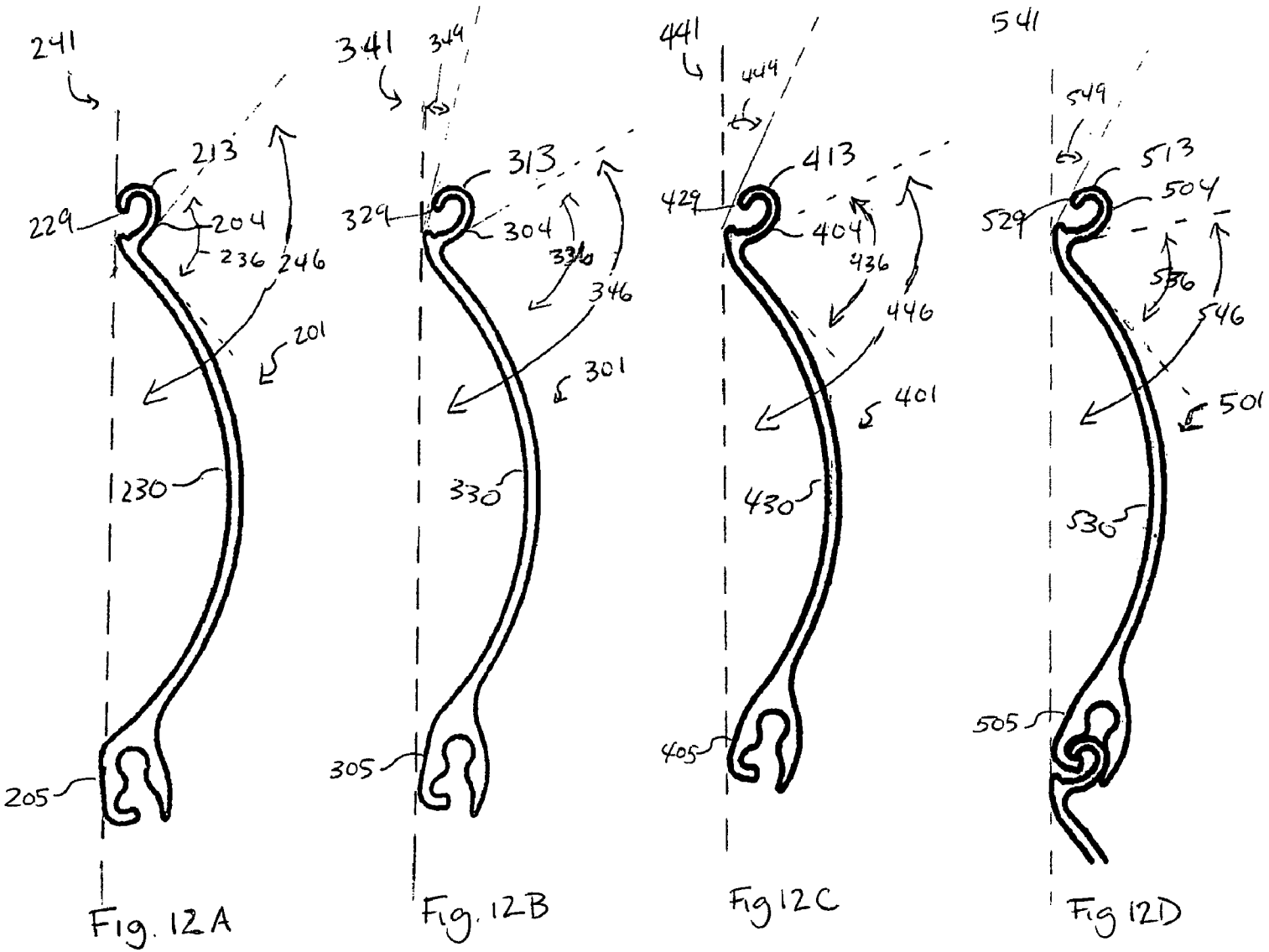
FIGS. 12A-D are side views of various embodiments according to the present invention.

FIGS. 12A-D show various embodiments of a shutter slat according to the present invention. In FIG. 12A, the semicircular hook-shaped member 213 of slat 201 is provided more upright, generally in line with axis 241, such that tip 229 terminates in line with protrusion 38. While angle 236 is slightly greater than 90°, the engaging track 204 extends from body 230 at an angle 246 of approximately 140°, which is less than 180° with respect to vertical axis 241. As discussed above, this angle 246 assists with articulation and aids in reducing the clearance between slats. Receptacle track 205 is also provided generally in line with axis 241.

In FIG. 12B, the semicircular hook-shaped member 313 of slat 301 is rotated clockwise at an angle 349 of approximately 17° from the upright position of hook-shaped member 213 of slat 201, such that tip 329 does not extend all the way back to axis 341. To provide a proper range of articulation between a plurality of slats 301, receptacle track 305 is also rotated clockwise relative to axis 341. Similarly, engaging track 404 of slat 401, as shown in FIG. 12C, is rotated at an angle 449 of approximately 25° clockwise from the position of hook-shaped member 213, with a similar rotation of receptacle track 405. Finally, engaging track 504 of slat 501, as shown in FIG. 12D, is rotated at an angle 549 approximately 30° clockwise from the position of hook-shaped member 213, with a similar rotation of receptacle track 505. In each of the three embodiments shown in FIGS. 12B-D, the respective engaging tracks 304, 404, and 504 are provided at an acute angle with respect to the respective bodies 330, 430, and 530. The angles range from about 58° for angle 536 of slat 501 to about 69° for angle 336 of slat 301. In all of these examples, the angle 246, 346, 446, 546 with respect to axis 241, 341, 441, 541 is less than 180°.

It has been found that each of the four embodiments, as shown in FIGS. 12A-D, provide excellent range of articulation. The particular of angles of rotation of the engaging track and receptacle track may be chosen based on the particular shutter application or may be chosen based on a particular diameter of support member 35 (shown in FIG. 10). At least in part because of the angles of the engaging track and receptacle track, each of the various embodiments roll more compactly against support members of different diameters. It has been found that 2.75 inch slats 301 according to FIG. 12B roll particularly compactly when using either a support member of 70 mm or a support member of 100 mm in diameter. Thus, the choice of angle of rotation may be made, at least in part, based on the diameter of the support member upon which the slats will be rolled.

Figure 13B:
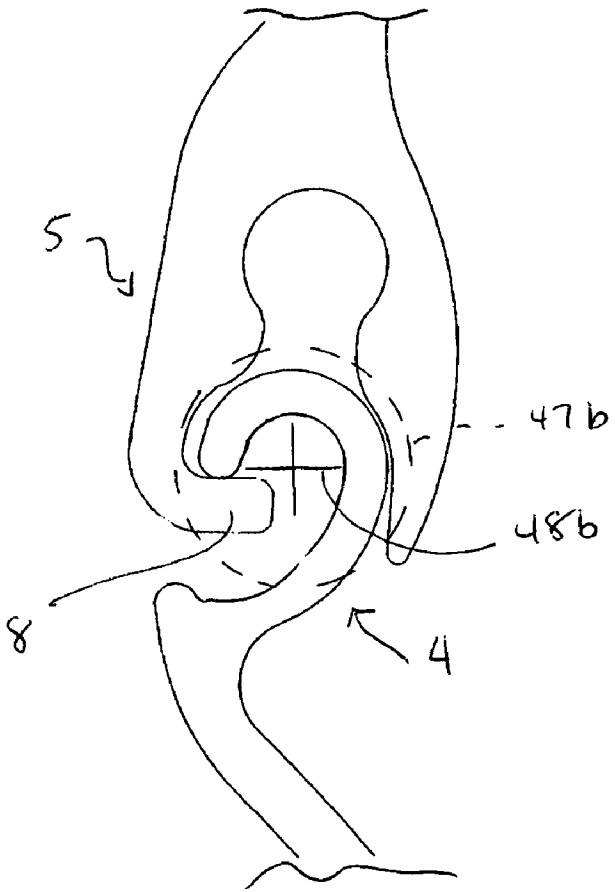
FIGS. 13A-B are similar to FIG. 4, with FIG. 13A showing the engagement in a fully articulated position and FIG. 13B showing the engagement in a fully open position.
Figure 13A:
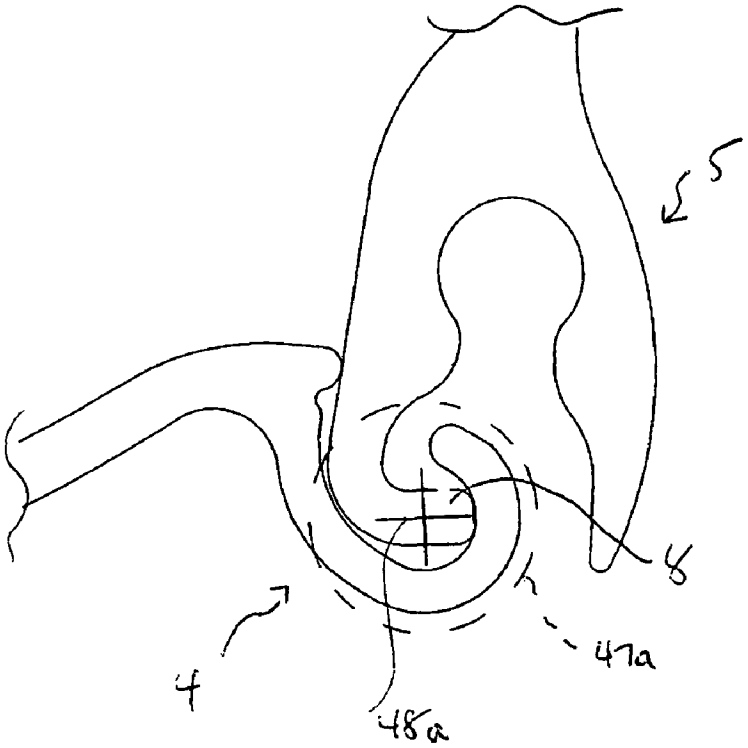

FIGS. 13A-B are similar to FIG. 4 in that they each show a detailed side view of an engaging track 4 in engaged relationship with the receptacle track 5 of an adjacent slat. FIG. 13A shows the engaging track 4 fully articulated with respect to the receptacle track 5 of an adjacent slat, as in the configuration of a shutter that has been full retracted and rolled about a support member. Crosshairs 48*a* show the pivot point as engaging track 4 rotates around lip 8 of the receptacle track 5. The circle of rotation is marked by dashed lines 47*a*. FIG. 13B shows the engaging track 4 and the receptacle track 5 in the fully open position, as in a fully deployed shutter. As seen in FIG. 13B, the pivot point, as indicated by crosshairs 48*b* has moved upward and to the right as compared to crosshairs 48*a*. This slippage provides for an excellent range of articulation between adjacent slats. However, the slippage adds to noise. Also, in some angles of engaging track 4 and receptacle track 5, the slippage may result in binding of one slat against another as the slats are being rolled, particularly when rolled by pushing up from the bottom of the shutter.

Figure 14B:
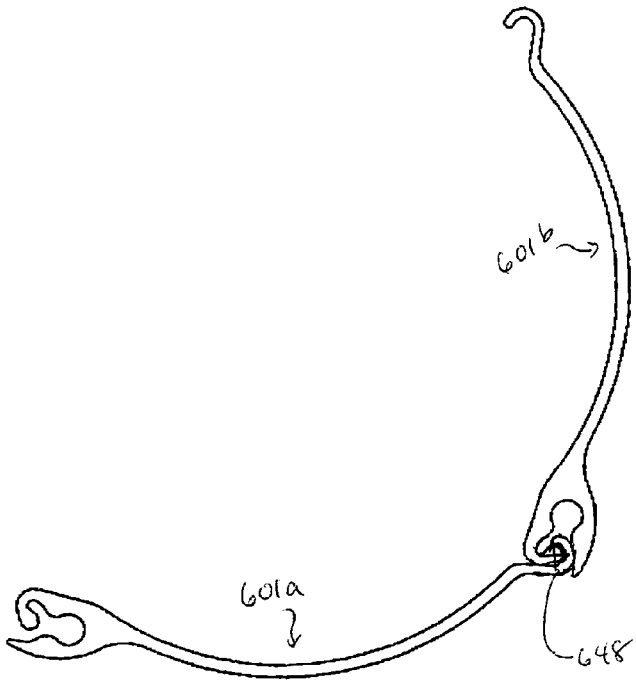
FIGS. 14A-B are similar to FIGS. 7A-B, except showing another embodiment of a slat according to the invention.
Figure 14A:
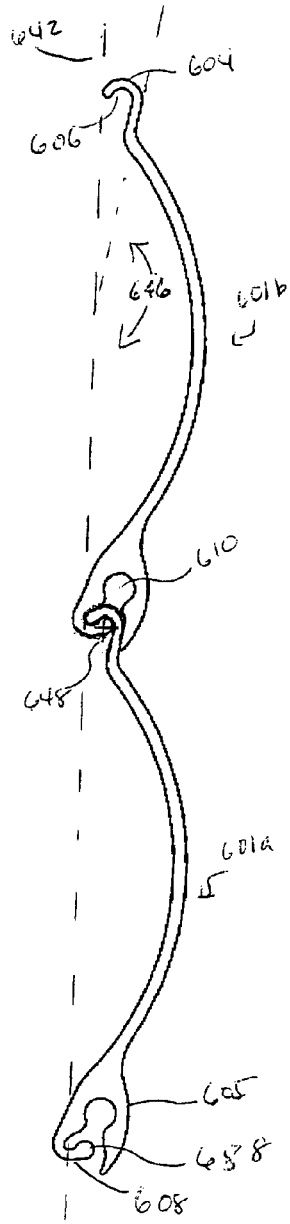

To further reduce noise and provide smoother articulation, several embodiments of the present invention have been developed in which a single pivot point is provided throughout the full range of articulation. FIGS. 14A-B are similar to FIGS. 7A-B, except that the slats 601*a* and 601*b* of FIGS. 14A-B are provided with a single pivot point, as indicated by crosshairs 648, which does not change position between the fully open position of FIG. 14A and the fully articulated position of FIG. 14B. To achieve this single pivot point, lip 608 of receptacle track 605 is provided with a semi-circular tip 688, as best seen on slat 601*a*, the radius of which matches that of the inner surface 606 of engaging track, 604. As illustrated, angle 646 is approximately 169°, but the selection of angle 646 may be made based on the particular application for the shutter, as described above with respect to FIGS. 12A-D.

Figure 15B:
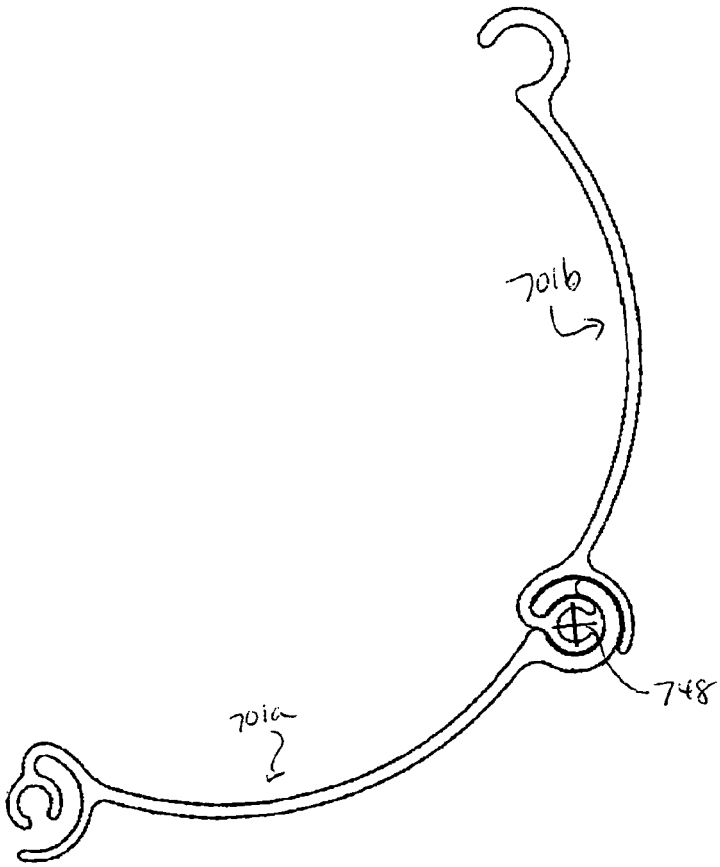
FIGS. 15A-B are also similar to FIGS. 7A-B, except showing still another embodiment of a slat according to the invention.
Figure 15A:
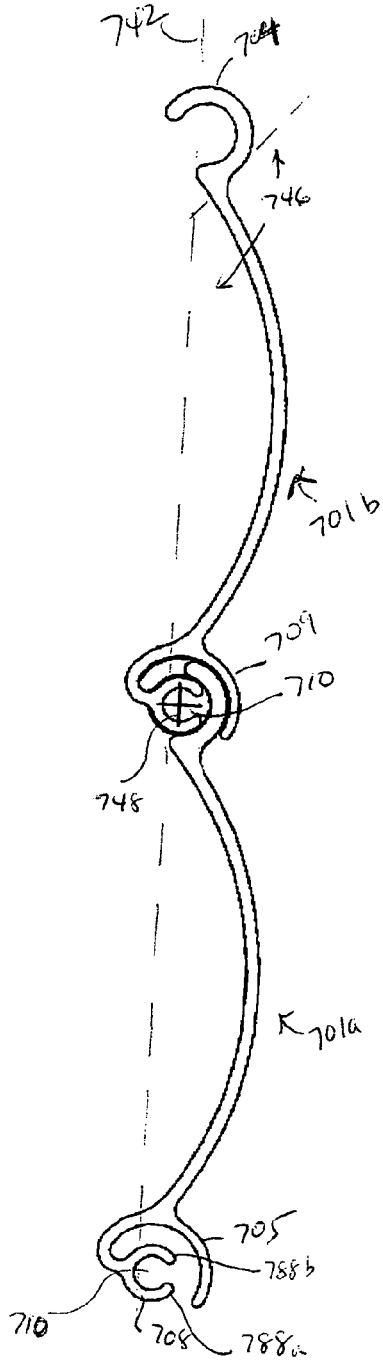

FIGS. 15A-B show another embodiment having a single pivot point. As with the embodiment of FIGS. 14A-B, crosshairs 748 of slats 701*a* and 701*b* do not change position between the fully open position of FIG. 15A and the fully articulated position of FIG. 15B. As best seen in slat 701*a*, the single pivot point is provided by a semi-circular tip of lip 708. However, in this embodiment, of receptacle track 705 terminates in a pair of semi-circular portions 788*a*, 788*b*. In this configuration, semi-circular portions 788*a*, 788*b* also define a space for receptacle 710. Accordingly, receptacle 710 is concentric with the articulation of engaging track 704 and receptacle track 705, but receptacle 710 is still protected from dirt, grime, and forced entry by engaging track 704 and guard 709. As illustrated, angle 746 is approximately 138°, but it is understood that the selection of angle 746 may be made based on the particular application for the shutter, as described above with respect to FIGS. 12A-D.

Modifications in addition to those described above may be made to the structures and techniques described herein without departing from the spirit and scope of the invention. Accordingly, although specific embodiments have been described, these are examples only and are not limiting on the scope of the invention.

The invention claimed is:

1. A slat for use with a rolling shutter, the slat having a first end and second end and a cross-section comprising:
- a body;
- a first engaging track connected with the body and including a hook; and
- a first receptacle track connected with the body and including a lip and a guard spaced apart from the lip and defining with the lip an opening into a first articulation space configured to articulatably retain a second engaging track of a second identical slat and further including a receptacle opening only into the articulation space through a gap, the gap being formed between two shoulders on the receptacle track, and wherein the gap cannot accommodate the second engaging track, the receptacle configured to receive an alignment device or a retention device for engaging the first and second slats with the shutter casing, wherein the first engaging track is configured to be articulatably retained by a second articulation space of second receptacle track of a third slat.

2. The slat of claim 1, wherein the first receptacle track and the first engaging track are configured to limit movement between the first receptacle track and the second engaging track and/or the first engaging track and the second receptacle track along the cross-sectional axis of the slats by 0.0041 inches.

3. The slat of claim 2 wherein the movement between the first receptacle track and the second engaging track and/or the first engaging track and the second receptacle track along the cross-sectional axis of the first and second slats by at most 0.0041 inches.

4. The slat of claim 1, wherein the protrusion of the first engaging track is configured to prevent the first engaging track and the second receptacle of the third slat from disengaging when rotated.

5. The slat of claim 1, wherein the first receptacle track includes a guard and a lip that are configured to prevent the first receptacle track and the second engaging track of the second slat from disengaging when rotated.

6. The slat of claim 5, wherein the lip of the first receptacle track is oriented towards the articulation space of the first receptacle track.

7. The slat of claim 5, wherein the guard and lip of the first receptacle track are configured to limit backbend rotation of the first receptacle track and the second engaging track to about 3 degrees.

8. A rolling shutter for displaceable engagement with a shutter casing, the rolling shutter comprising:
- a first slat having a first end and a second end and a cross-section comprising:
  - a first body; and
  - a first engaging track connected with the first body and including a first hook;
  - a first receptacle track connected with the first body and including a lip extending from a bend toward a guard spaced apart from the lip to define an opening into an articulation space and a receptacle opening only into the articulation space through a gap, the gap being formed between two shoulders on the receptacle track, and wherein the gap cannot accommodate an engaging track of an identical slat, the receptacle configured to receive a device configured to engage the slat with the shutter casing, or align the first slat with another slat, or both; and
- a second slat including:
  - a second body; and
  - a second engaging track connected with the second body;
  - wherein the first engaging track is configured to be articulatably retained by the second receptacle track of the second slat and the first receptacle track is configured to rotationally retain a third engaging track of a third slat.

9. A slat for use with a rolling shutter, the slat having a first end and a second end and a cross-section comprising:
- a body;
- a first engaging track connected with the body; and
- a first receptacle track connected with the body, said receptacle track comprising a discontiguous articulation surface partly enclosing a first articulation space configured to articulatably retain a second engaging track of a second identical slat through a first opening,
- a receptacle separated from and opening only into the articulation space through a gap,
- wherein the receptacle is configured to receive an alignment device or a retention device for engaging the first and second slats with the shutter casing,
- wherein the discontiguous articulation surface comprises a first and a second surface, each of the first and second surfaces ending at a shoulder, the shoulders being oriented toward one another, wherein the shoulders are separated by the gap, and the gap is incapable of accommodating the engaging track of the second slat; and
- wherein the first engaging track is configured to be articulatably retained by a second articulation space of second receptacle track of a third slat.

10. The slat of claim 9, wherein a pivot point within the first articulation space about which the first receptacle track of the first slat and the second engaging track of the second slat rotate about each other moves as the first and/or second slats rotate.

11. The slat of claim 9, wherein the first receptacle track includes a lip having a semi-circular tip and wherein a pivot point about which the first receptacle track of the first slat and the second engaging track of the second slat rotate about each other remains stationary as the first and/or second slats rotate.

12. The slat of claim 11, wherein a radius of the semi-circular tip of the lip equals the radius of an inner surface of the engaging track.

13. A slat for use in a rolling shutter, comprising a first end, a second end, a first edge and a second edge, and a cross-section comprising:

a body portion extending between the first edge and the second edge;

the first edge comprising a first hook-shaped track;

the second edge comprising a second track, wherein said second track has a articulation surface, the articulation surface partly enclosing an articulation space adapted to receive a first track of an adjacent identical slat to form a hinge;

and wherein the second track has a discontiguous inner surface, said discontiguous inner surface having a gap between two shoulders, the gap communicating between the articulation space defined by the inner surface of the curved extension member and a substantially circular receptacle that is capable of receiving a retention or alignment device, said receptacle opening only into the gap between the receptacle and articulation space, and capable of accommodating an alignment device or retention device for securing the slat to a rolling shutter guide, and wherein said gap cannot accommodate a first track of an adjacent identical slat.

14. The slat of claim 13, further comprising a retention or alignment device in the receptacle.

15. A slat for use with a rolling shutter, the slat having a first and second end , a first edge and a second edge, and a cross-section comprising:

a body extending between the first edge and the second edge, and an inner face and an outer face, each of first face and second face extending along a curve between the first and second edges;

the first edge comprising an engaging track connected with the body, said engaging track extending in a decreasing-radius arc for more than 225 degrees from the edge, said engaging track joined to the first edge of body at a smooth curved junction transitioning from the curves of the inner and outer face of body to the arc of the engaging track with no protrusion; and the second edge comprising a receptacle track connected with the body, said receptacle track comprising an interior member and an exterior member, and each having an end proximate the body;

said interior member and exterior member each having an inner surface with a shoulder, the two shoulders directed at one another and defining a gap between them, the inner surfaces of the interior and exterior member defining a substantially circular receptacle between the ends of the two inner surfaces proximate the body and the gap, wherein the interior member has an outer surface extending in a curve congruent with the curve of the inner face of the body to a bend distal from the body and a lip extending toward the exterior member;

wherein the inner surface of the interior member extends from the shoulder to a bend and a lip extending toward the exterior member, wherein the exterior member has a distal end that is a tip, an outer surface and the inner surface of the exterior member defining a thick portion in the vicinity of the shoulder of the exterior member, and the inner surface and the outer surface extend from the shoulder and terminate at the tip; and wherein the inner surface of the exterior member from the shoulder to the tip and the inner surface of the interior member from the shoulder to the lip define an articulation space configured to articulatably retain an engaging track of a second identical slat through an opening between the lip and the tip, wherein the opening is defined by a distance between distal ends of the two inner surfaces, wherein the portions of the inner surfaces from the gap to the distal ends of the inner surfaces form a discontiguous articulation surface with the gap, and wherein when the engaging track of the second slat is articulatably retained in the articulation space such that an axis of the second slat is aligned with the axis of the slat, a portion of the outer surface of the interior member distal from the body along the vertical axis of the slat is horizontally offset from the engaging track of the second identical slat.

* * * * *